United States Patent [19]

Schuder et al.

[11] 4,412,750

[45] Nov. 1, 1983

[54] TIMING MECHANISM WITH TWO SEPARATE PROGRAMS OPERATING SEPARATE SWITCH ACTUATORS AND HAVING AN ALARM SYSTEM

[75] Inventors: Maurice E. Schuder, Indianapolis; Richard W. Stafford, Clayton, both of Ind.

[73] Assignee: Emhart Industries, Inc., Indianapolis, Ind.

[21] Appl. No.: 187,410

[22] Filed: Sep. 15, 1980

Related U.S. Application Data

[62] Division of Ser. No. 947,594, Oct. 2, 1978, Pat. No. 4,242,746.

[51] Int. Cl.[3] ..... G04F 8/00; H01H 43/10

[52] U.S. Cl. ..... 368/98; 368/109; 200/38 R

[58] Field of Search ..... 368/98-101, 368/107-109, 243-244, 250, 254, 269; 200/38 R, 38 FA; 340/384 R, 402

[56] References Cited

U.S. PATENT DOCUMENTS

| | | | |
|---|---|---|---|
| 2,150,633 | 3/1939 | Rhodes et al. | 368/100 |
| 3,591,956 | 5/1969 | Draghi | 368/100 |
| 3,866,003 | 2/1975 | Fox | 200/38 FA |
| 4,020,625 | 5/1977 | Mahon et al. | 368/100 |

*Primary Examiner*—Vit W. Miska

*Attorney, Agent, or Firm*—Robert F. Meyer; David W. Gomes

[57] ABSTRACT

One of two actuator arms is responsive to a sharp drop in a step of a cam means, the arm engaging the bottom of the step to limit its travel. A striker carried by the arm continues in the direction of the drop to engage an alarm means.

6 Claims, 4 Drawing Figures

TIMING MECHANISM WITH TWO SEPARATE PROGRAMS OPERATING SEPARATE SWITCH ACTUATORS AND HAVING AN ALARM SYSTEM

This application is a division of application Ser. No. 947,594, filed Oct. 2, 1978, now U.S. Pat. No. 4,242,946.

BACKGROUND OF THE INVENTION

Generally speaking, the present invention pertains to a timing mechanism having a power drive means rotating first and second cam means and a double pole switch means opening and closing in response to a rotation of the cam means comprising coupling means coupling the power drive means to the cam means; first and second movable spring blades disposed in substantially parallel relation and having lengths which are substantially equal, first and second electrical contacts one each carried on each of the blades respectively near distal ends thereof and facing each other, a third spring blade fixedly disposed between the first and second spring blades and in substantial parallel relation therewith, the third spring blade having a length shorter than the lengths of the first and second spring blades so as to provide a gap between the same at their distal ends, and third and fourth electrical contacts carried on opposed surfaces of the third spring blade in operational position with the first and second electrical contacts; and first and second actuator arms pivotly mounted in ends thereof to be pivoted in response to the cam means, a distal end of one of the actuator arms entering the gap and engaging the first and second spring blades to open the first and second electrical contacts from said third and fourth electrical contacts, a distal end of the other actuator arm entering the gap and engaging one of the first and second spring blades to open one of said first and second electrical contacts from one of the third and fourth electrical contacts.

One of the cam means includes a sharp contour to a step with one of the actuator arms engaging the cam means to quickly drop at the sharp drop contour to the step. The timing mechanism also includes, in this embodiment, an audible sound means having a spring biased striker pivotly carried on the actuator arm and engaging the audible sound means, whereby the striker drops with the actuator arm and continues dropping after the arm engages the step to strike the audible sound means.

In another embodiment of the invention there is provided a short pulsing cycle within a complete program of the timing mechanism. In this embodiment one of the actuator arms serves to provide the short pulsing cycle and there is a manual selector means serving as a means to disengage the second actuator arm from its cam means to render the pulsing cycle inoperative for a predetermined period of time.

The present invention pertains to a timing mechanism and more particularly to a timing mechanism which provides a short pulsing cycle within a timing program and an alarm system to signal the end of a program and wherein a double pole switching means is also provided.

Timing mechanisms have for sometime been used to control the functions of various appliances such as washers, dryers and microwave ovens. Depending upon the application, such timing mechanisms need to provide various programs. For example, in the case of a timing mechanism for a microwave oven there is a need to provide a short pulsing cycle operable within the overall program. Such a system usually requires a double pole switching arrangement and in most cases there should also be a means to remove the pulsing cycle from the system if desired. In addition, there is also sometimes a need to provide an alarm means in conjunction with the timing mechanism to signal the end of a program.

OBJECTS OR FEATURES OF THE INVENTION

Accordingly, it is a feature of the present invention to provide a timing mechanism having a means to provide a double pole switching arrangement. Another feature of the invention is to provide such a timing mechanism wherein a double pole switching arrangement is provided by three parallel spring blades, each having electrical contacts in operational alignment with each other and wherein actuator arms responsive to separate cam means selectively engage the spring blades. Another feature of the invention is the provision of such a timing mechanism wherein two outside movable spring blades extend in length beyond a fixed middle third blade to provide a gap into which the actuator arms enter to engage the blades. Another feature of the invention is the provision of such a timing mechanism wherein the distal end of one of the actuator arms enters the gap and engages the outside spring blades to open and close electrical contacts from the middle blade and wherein the distal end of the other actuator arm enters the gap and engages one of the outside blades to open its contact from the electrical contacts of the middle third blade.

Yet another feature of the invention is the provision of such a timing mechanism wherein there is provided an audible sound means with a means to engage the sound means. Another feature of the invention is the provision of such a timing mechanism having a cam means which includes a sharp drop contour to a step and wherein an actuator means engages the cam means to quickly drop at the sharp contour to the step and wherein a spring biased striker is pivotly carried on the actuator so that it will continue to drop after the actuator engages the step to strike the audible sound means.

Yet another feature of the invention is the provision of such a timing mechanism having a short pulsing cycle operable within the complete program of the timing mechanism. Still another feature of the invention is the provision of such a timing mechanism wherein the programs are provided by two actuator arms engaging separate cam means and wherein there is a manual selector means permitting one of the arms to become disengaged from its cam means. These and other features of the invention will be apparent from the following description taken in combination with the accompanying drawings.

DETAILED DESCRIPTION OF THE INVENTION

Figure 1:
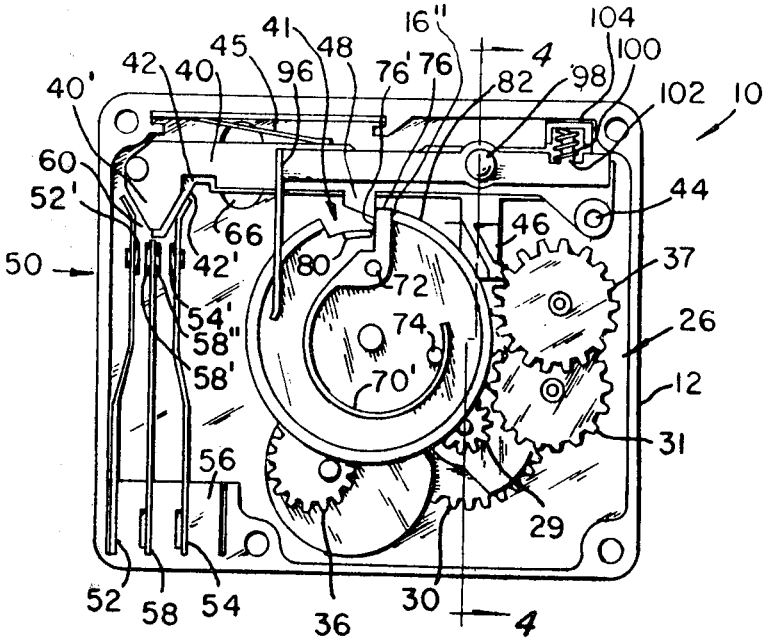
FIG. 1 is a top view of a timing mechanism employing the features of the invention.

Referring to the drawings, there is shown a timing mechanism 10 employing the features of the invention. The elements of the timing mechanism are enclosed in a cup-shaped housing member 12 with a cover plate 14 enclosing the open end of the housing. A cam 16 is fixedly carried on a shaft 18 which is rotatably journalled in the base 12' of cup-shaped member 12. A second cam 20 is rotatably journalled on shaft 22 which is fixedly carried in base member 12' of the cup-shaped housing. Both of the cams are coupled to a suitable motor drive means 24, which is schematically shown in FIG. 4, through coupling means 26. Coupling means 26 includes a series of gears and pinions 28, 29, 31, 33, 34, 35, 36, 37 and 38 and a clutch means 30. As more particularly shown in FIG. 3, the gears and pinions include two pairs of cooperating non-circular gears such as scroll gears 33, 35, and 36, 38. Such scroll gears provide for a non-linear speed of rotation to cam 16 such that the rotation of the cam can be varied as desired. As shown cam 20 is located upstream toward the motor from the scroll gears such that it is driven at a constant speed.

A pair of actuator arms 40 and 42 are pivotly carried on a post 44, the post being carried by housing member 12. Actuator arm 42 has a cam follower 46 which engages cam 20 while actuator arm 40 has a cam follower 48 that engages cam 16. Thus, actuator arm 40 pivots in accordance with the program of cam 16 while actuator arm 42 pivots in accordance with cam 20. Both the actuator arms are spring biased toward their respective cam through a spring 45 which includes a pair of fingers 45' and 45" engaging actuator arms 42 and 40 respectively.

Referring to FIG. 1, in accordance with one aspect of the invention, a double pole switching means is provided with the combination of actuator arms 40 and 42 and double pole switching means 50. Double pole switching means 50 includes outer movable spring contact blades 52 and 54 and middle fixed contact blade 58 all of which are mounted in terminal block 56. The terminal block is formed as part of housing member 12. As shown, the blades are in substantial parallel relation to each other and the outer blades 52 and 54 have lengths which are substantially equal and longer than the fixed middle blade 58 to provide a gap 60 at the distal ends of the outer blades and at the end of the middle blade. The outer blades 52 and 54 carry electrical contacts 52' and 54' near their distal ends in line with and facing each other. The middle contact blade 58 carries electrical contacts 58' and 58" at its distal end in line with and facing the other two contacts. Each of the actuator arms include V-shaped extensions 40' and 42' extending from the distal ends of the actuator arms. When the actuator arms are pivoted in accordance with their respective cams, the V-shaped extensions will enter gap 60 to engage the outer spring contact blades 52 and 54 to selectively open and close the electrical contacts. When being used in a microwave oven, for example, when the oven is working, all the contacts will be closed. During this time the oven can be intermittently turned off and on through cam 20 operating actuator arm 42 to open contacts 54' and 58". At the end of the complete cycle cam 16 causes actuator arm 40 to drop to disengage contacts 52' and 58' to completely open all the contacts.

Figure 2:
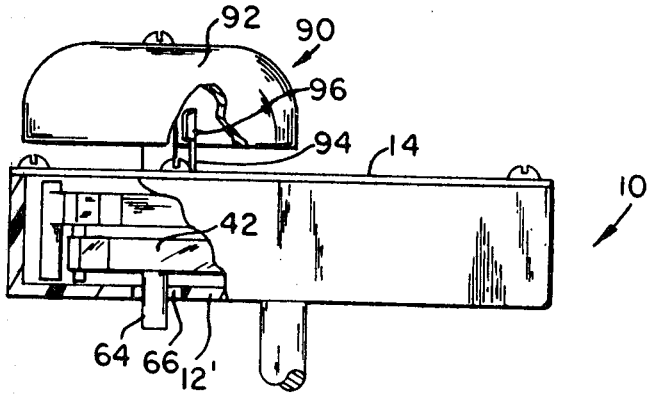
FIG. 2 is an end view of the timing mechanism of FIG. 1 with portions thereof broken away.
Figure 3:
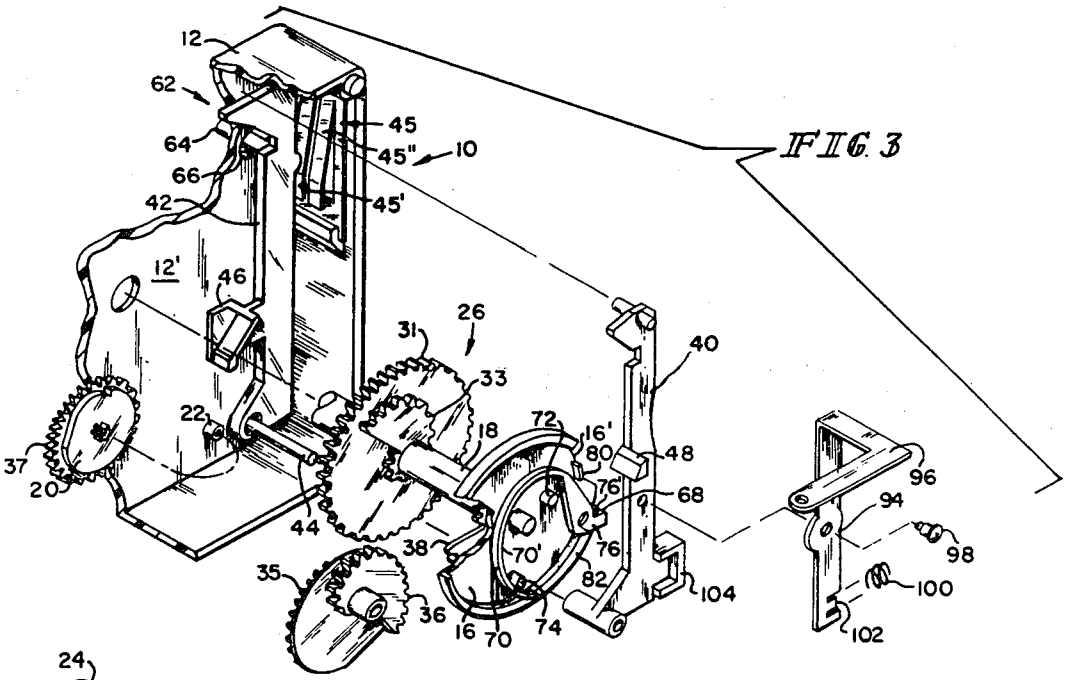
FIG. 3 is an exploded view of the cam means of the timing mechanism and a coupling means which couples the cam means to the motor drive means of the timing mechanism.
Figure 4:
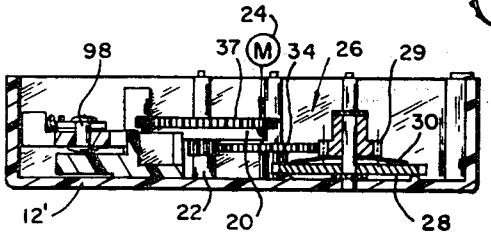
FIG. 4 is a view taken along the line 4—4 of FIG. 1.

Referring to FIGS. 2 and 3 a manual selector means 62 permits actuator arm 42 to be disengaged from the system. Manual selector means 62 includes a handle 64 which is carried by the actuator arm 42 and extends through an elongated slot 66 so that the handle may be moved lengthwise in the slot. Although not shown in the interest of simplicity it should be understood that means would be provided to hold the handle in a desired position.

Cam 16 has a very sharp drop contour 68 such that actuator arm 40 very quickly falls, the fall being terminated by step 16' of the cam. The sharp drop contour is provided by a spring pawl 70 carried on cam 16. The spring pawl is pivotly carried at one end by post 72 which is carried on the cam and the pawl is slideably carried by its inner surface 70' by being sprung over post 74 which is also carried by the cam 16. The spring pawl has a lug 76 that has a very sharp edge 76' to provide the sharp contour 68. The lug 76 pivots between a tab 80 and rim 82 which extends around the periphery of the cam except for the space provided by the step 16'. As viewed in FIG. 1, when cam 16 rotates in a clockwise fashion cam follower 48 approaches the lug 76 and then quickly drops when it reaches the straight edge 76'. When the cam is manually reset by rotating cam 16 in a counter-clockwise direction lug 76 will pivot a sufficient amount to expose the tapered edge 16" of step 16' to permit the follower 48 to become disengaged from the lug. Upon follower 48 being relieved from the lug, the lug will return to its original position due to the action of the spring pawl.

Referring to FIGS. 1, 2 and 3, in accordance with another aspect of the invention there is provided an alarm to indicate the end of a program cycle of the timing mechanism. Such alarm is provided by an audible sound means 90 which includes a bell 92 that is carried on the cover 14 and a striker 94. Striker 94 includes an L-shaped arm 96 pivotly carried on post 98 which extends through and is carried by actuator arm 40. The L-shaped striker engages the bell. The striker is spring biased at its one end through a coil 100 which is carried on a post 102 extending from the striker and which extends into a channel 104 that is carried by the actuator arm 40. Stop means 41 stops the drop of the actuator arm. In the present embodiment, stop means 41 includes step 16' of cam 16. When actuator arm 40 drops at the end of a cycle at the straight edge 76' and quickly stops at step 16' of cam 16 striker 96 continues to drop to engage or strike the bell 92 to indicate the end of the cycle. When the striker engages the bell 92 the pivoting of the striker causes coil 102 to compress to then disengage the striker from the bell.

What is claimed is:

1. A timing mechanism comprising:

(a) power drive means, (b) cam means coupled to said power drive means to be driven thereby, said cam means including a sharp drop contour;

(c) actuator means engaging said cam means to quickly drop at said sharp drop contour, and stop means quickly limiting said drop;

(d) alarm means;

(e) a spring biased striker pivotly carried on said actuator means and engaging said alarm means; whereby said striker drops with said actuator means and continues dropping after said actuator means engages said stop means to strike said alarm means.

2. A timing mechanism according to claim 1 wherein said stop means includes a step of said cam means.

3. A timing mechanism according to claim 1 wherein said actuator means includes an arm pivotly mounted at an end thereof and wherein said arm is spring biased to be engaged with said cam means.

4. A timing mechanism according to claim 3 wherein said spring biased striker is pivotly mounted near the center of said arm and is spring biased by a coil spring biased between said striker and said arm at said pivotly mounted end of said arm.

5. A timing mechanism according to claim 4 wherein said arm includes a channel extending from said arm and said striker includes a notch and said coil is carried in said notch and said channel.

6. A timing mechanism according to claim 5 wherein said coil is carried on a post carried in said notch.

* * * * *